US005182489A

United States Patent [19]

Sano

[11] Patent Number: 5,182,489

[45] Date of Patent: Jan. 26, 1993

[54] PLASMA DISPLAY HAVING INCREASED BRIGHTNESS

[75] Inventor: Yoshio Sano, Tokyo, Japan

[73] Assignee: NEC Corporation, Tokyo, Japan

[21] Appl. No.: 629,420

[22] Filed: Dec. 18, 1990

[30] Foreign Application Priority Data

Dec. 18, 1989 [JP] Japan ..... 1-328827

[51] Int. Cl.[5] ..... H01J 61/067; H01J 61/42

[52] U.S. Cl. ..... 313/485; 313/113; 313/584; 313/586

[58] Field of Search ..... 313/485, 586, 584, 113

[56] References Cited

U.S. PATENT DOCUMENTS 4,352,042 9/1982 Lorenz et al. ..... 313/485
4,692,662 9/1987 Wada et al. ..... 313/113 X
4,827,186 5/1989 Knauer et al. ..... 313/485

FOREIGN PATENT DOCUMENTS 2745101 4/1979 Fed. Rep. of Germany ..... 313/485

*Primary Examiner*—Palmer C. DeMeo
*Attorney, Agent, or Firm*—Laff, Whitesel, Conte & Saret

[57] ABSTRACT

A plasma display panel of the surface discharge type in which a maintaining discharge is generated between electrodes formed on the same substrate, includes first and second insulating substrates separated from each other to form a discharge space therebetween. A spacer having a partition wall in the form of a grid is located between the first and second insulating substrates so as to partition the discharge space into a number of pixels. Electrodes for maintaining discharge are provided on the first insulating substrate, and phosphor is located on the second insulating substrate within each of the pixels. The first insulating substrate is located at a display side.

12 Claims, 6 Drawing Sheets

PLASMA DISPLAY HAVING INCREASED BRIGHTNESS

BACKGROUND OF THE INVENTION

1. Field of the Invention

The present invention relates to a plasma display panel, and more specifically to a plasma display panel of the dot matrix type, which is now expected to be widely used in personal computers and office work stations which are now remarkably advancing, and in flat panel type television receivers expected to further develop in future.

2. Description of Related Art

In Japanese Patent Application No. Hei 1-108003 filed on Apr. 26, 1989, the applicant proposed a color plasma display panel which includes first and second insulating plates such as glass plates separated from each other to form therebetween a discharge space, which is divided by a spacer having a partition wall in the form of a grid or a lattice so that the discharge space is partitioned into a number of pixels. On an inside surface of the first insulating plate, a plurality of row electrodes are formed in such a manner that each of the row electrodes is aligned with a corresponding partition wall extending in a row direction, so that each pair of adjacent row electrodes face to one pixel, and on an inside of the second insulating plate, a plurality of column electrodes are formed to pass through a center portion of one array of pixels arranged in one column direction. A phosphor is deposited on the column electrode within each of the pixels, and a discharge gas is filled into each of the pixels defined by the first and second insulating plates and the grid-shaped partition wall of the spacer.

If a high voltage pulse is applied between one row electrode and one column electrode, an electric discharge is created within a pixel designated by the row electrode and the column electrode applied with the high voltage pulse. Thereafter, the electric discharge is maintained by applying an alternate current voltage between a pair of row electrodes facing to the pixel in which the electric discharge has been created by the high voltage pulse. This discharge is called a maintaining discharge. In addition, the discharge generated and maintained between electrodes located on the same substrate is called a surface discharge. This discharge generates a ultraviolet light, which excites the phosphor. As a result, a visible light is generated by the excited phosphor. This generation of the visible light can be stopped by reducing or eliminating the alternate current voltage applied between the pair of adjacent row electrodes.

Therefore, a dot matrix display can be realized by locating the row electrodes and the column electrodes in the form of a matrix so that the row electrodes and the column electrodes intersect perpendicularly to each other. In addition, if the phosphor is divided into three primary colors, so that each of the pixels is filled with selected one of the three primary colors, a color plasma display can be realized.

In the above mentioned plasma display panel, however, a surface of the phosphor receiving the ultraviolet light generated by the electric discharge is different from a surface of the phosphor emitting the visible light to a viewer, namely, in a display direction. In this case, the magnitude of the light emitted toward the display direction, namely, the brightness, depends upon the thickness of the phosphor. Specifically, if the phosphor is thicker or thinner than an optimum thickness, the brightness will decrease. On the other hand, the display is required to have as high brightness as possible, in order to give a sufficient distinction. Therefore, the prior proposed plasma display panel has been required to have the phosphor of the optimum thickness. However, it is very difficult to deposit a phosphor of a constant thickness uniformly throughout a whole surface of the display panel. Particularly, difficulty has been increased in the case of depositing three primary color phosphors of uniform thickness to different pixels.

SUMMARY OF THE INVENTION

Accordingly, it is an object of the present invention to provide a plasma display panel which has overcome the above mentioned defect of the prior proposed one.

Another object of the present invention is to provide a plasma display panel capable of having a high brightness without a strictly controlled thickness of phosphor.

The above and other objects of the present invention are achieved in accordance with the present invention by a plasma display panel of the surface discharge type in which a maintaining discharge is generated between electrodes formed on the same substrate, including first and second insulating substrates separated from each other to form a discharge space therebetween, a spacer having a partition wall in the form of a grid located between the first and second insulating substrates so as to partition the discharge space into a number of pixels, each of which is defined by the first and second insulating substrates and the partition wall of the spacer, the pixels being separated from one another by the partition wall of the spacer, wherein the improvement comprising electrodes for maintaining discharge provided on the first insulating substrate, and phosphor located on the second insulating substrate, the first insulating substrate being located at a display side.

Preferably, each of the electrodes for maintaining discharge includes a combination of a transparent electrode and a metal electrode. In addition, the second insulating substrate has visible light reflecting means provided between the phosphor and the second insulating substrate.

With the above mentioned arrangement, light generated by the phosphor is extracted to an outside through the first insulating substrate between the electrodes for maintaining discharge. In other words, the light generated by the phosphor is not extracted to the outside through the phosphor itself. Therefore, the thickness of the phosphor is sufficient if it exceeds a certain minimum thickness. Namely, it is not necessary to strictly control the thickness of the phosphor. Accordingly, this feature is very convenient to manufacturing of the plasma display panel. In addition, efficiency for extracting light from the phosphor is a double or more of the prior proposed plasma display, and therefore, it is possible to easily manufacture a high brightness plasma display.

In the case that the electrodes for maintaining discharge are formed of metal electrodes, an effective area of each pixel looked from the first insulating substrate is reduced in comparison with an area confined by the partition wall of the space. This is not convenient in increasing a surface averaged brightness of the plasma panel. In order to increase the surface averaged brightness of the plasma panel while using the metal electrodes for maintaining discharge, it is considered to reduce the width of the metal electrodes for maintaining discharge so that an space between each pair of adjacent metal electrodes for maintaining discharge is increased. However, the reduction of the width of the metal electrodes for maintaining discharge has a certain restriction, since the metal electrodes for maintaining discharge are required to exceed beyond the partition wall of the spacer at some degree in order to stably create the discharge.

In a preferred embodiment, each of the electrodes for maintaining discharge is composed of a combination of a transparent electrode having a relatively high electric resistance and a transparency of visible light and a metal electrode having a low electric resistance. In this embodiment, the electrodes for maintaining discharge can have an equivalently low electric resistance, and on the other hand, the effective area of each pixel looked from the first insulating substrate can be increased. Accordingly, a plasma panel having a high surface averaged brightness can be realized. Particularly, if the metal electrodes are confined within an region overlapping the partition wall of the spacer, since the light generated by the phosphor toward the display side is not obstructed or blocked by the metal electrode, a high brightness can be obtained.

In addition, the second insulating substrate has visible light reflecting means provided between the phosphor and the second insulating substrate. In this case, the light emitted by the phosphor toward the second insulating substrate is reflected by the visible light reflecting means toward the first insulating substrate. This feature makes it possible to realize a plasma display panel having a further increased brightness.

The above and other objects, features and advantages of the present invention will be apparent from the following description of preferred embodiments of the invention with reference to the accompanying drawings.

DESCRIPTION OF THE PREFERRED EMBODIMENTS

Figure 1A:
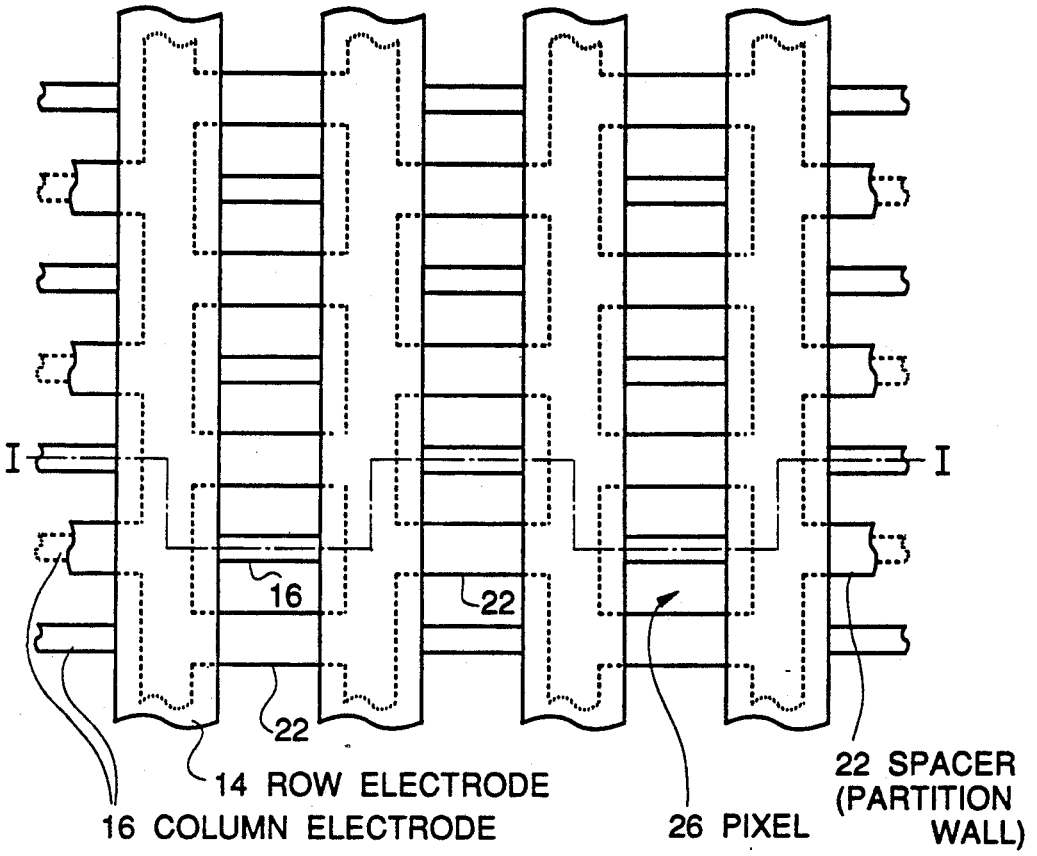
FIG. 1A is a diagrammatic partial plan view of a first embodiment of the plasma display panel in accordance with the present invention.
Figure 1B:
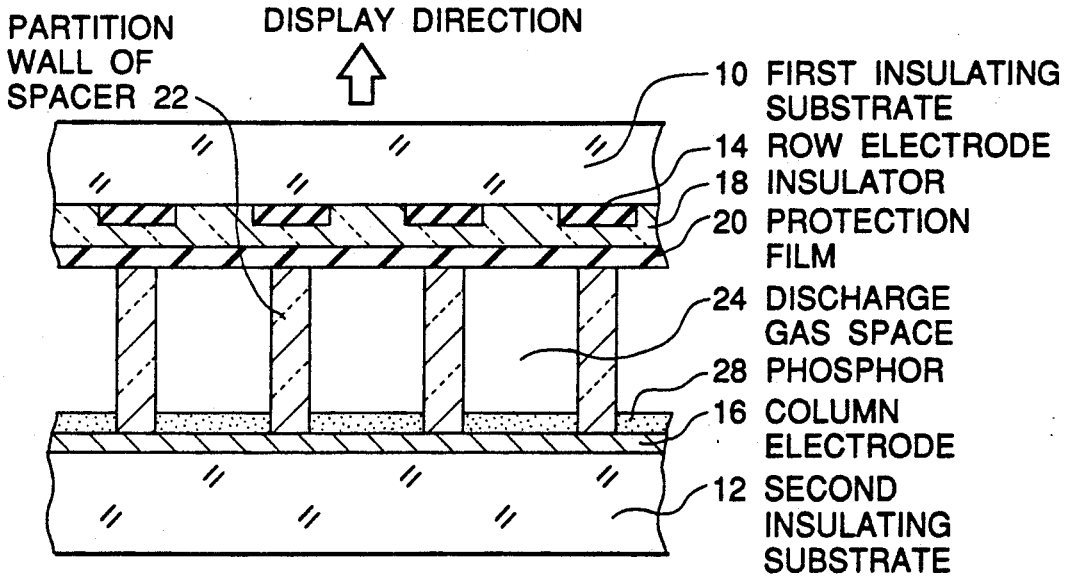
FIG. 1B is a diagrammatic partial sectional view taken along the chain line I—I in FIG. 1A.

Referring to FIG. 1, there is shown a diagrammatic partial plan view of a first embodiment of the plasma display panel in accordance with the present invention. Further, referring to FIG. 1B, there is shown a diagrammatic partial sectional view taken along the chain line I—I in FIG. 1A.

The shown plasma display panel includes a first insulating substrate 10 made of for example soda glass and a second insulating substrate 12 also made of for example soda glass. On an inside surface of the first insulating substrate 10, a plurality of row electrodes 14 are formed in parallel to one another and separately from one another, and on an inside surface of the second insulating substrate 12, a plurality of column electrodes 16 are formed in parallel to one another and separately from one another. Each of the column electrodes 16 extends in a direction perpendicular to the row electrodes 14. Each of the row electrodes 14 and the column electrodes 16 is formed of for example a thick film of silver. The row electrodes 14 formed on the inside surface of the first insulating substrate 10 is covered with an insulating layer 18, which is in turn formed of a thick film of glass having a thickness of 20 μm. The insulating layer 18 is coated with a protection film 20 made of for example MgO. This protection film 20 serves to protect the insulating layer 18 from a maintaining discharge generated between the row electrodes 14.

The first and second insulating substrates 10 and 12 formed as mentioned above are separated by a spacer 22 and airtightly bonded to the spacer 22 so as to form a discharge space 24 between the first and second insulating substrates 10 and 12. The spacer 22 includes a partition wall in the form of a grid or a lattice so as to partition the discharge space into a number of pixels 26. For example, the spacer constituted of the partition wall 22 is formed of a glass plate which has a thickness of 0.2 mm and which is etched into a pattern of grid or lattice. The discharge space 24 is filled with a discharge gas composed of helium (He) gas including 4% of xenon (Xe) gas and having a gas pressure of 200 Torr.

In addition, as seen from FIG. 1A, the partition wall 22 extending in a direction parallel to the row electrodes 14 are located to overlap a corresponding one of the row electrodes 14. A width of the row electrodes 14 is larger than that of the partition wall 22 extending in a direction parallel to the row electrodes 14. The pixels 26 confined by the partition wall 22 are arranged in a staggered pattern so that each of the column electrodes 16 extends alternately to pass through a center portion of the pixel and to overlap the partition wall 22 extending in a direction parallel to the column electrodes 16. Within each of the pixels 26, a phosphor 28 is deposited to cover the inside surface of the second insulating substrate 12 and the column electrodes 16 formed on the inside surface of the second insulating substrate 12.

If a high voltage pulse is applied between one row electrode 14 and one column electrode 16, an electric discharge is created within a pixel 26 designated by the row electrode 14 and the column electrode 16 applied with the high voltage pulse. This electric discharge is maintained by applying an alternate current voltage between a pair of adjacent row electrodes 14 facing to the same pixel 26 in which the electric discharge has been created by the high voltage pulse, even after the high voltage pulse has terminated. This maintaining discharge generates a ultraviolet light, which excites the phosphor 28. Visible light generated by the excited phosphor 28 passes through the first insulating substrate 10 toward a display direction.

As would be understood from the above description and as seen from FIGS. 1A and 1B, the first insulating substrate 10 having the row electrodes 14 for the maintaining discharge on the inside surface thereof is directed toward the display direction, namely at a front side of the display panel. On the other hand, the phosphor 28 is formed on the second insulating substrate. Therefore, the surface of the phosphor 28 that receives the ultraviolet light generated by the electric discharge is the same as the surface of the phosphor 28 from which the emitted visible light is extracted to the outside of the plasma display panel. Therefore, the visible light emitted by the phosphor 28 can be effectively extracted to the outside of the plasma display panel.

Specifically, the plasma display panel was actually fabricated under the condition that the pitch of the pixel is 400 μm; the interval of the row electrodes 14 is 240 μm; the width of the row electrodes 14 is 160 μm; the phosphor 28 is composed of $Zn_2SiO_4$:Mn for green, (Y, Gd)$BO_3$:Eu for red and $BaMgAl_{14}O_{23}$:Eu for blue; and the thickness of the phosphor 28 is in a range of 20 μm to 50 μm.

The plasma display panel thus formed in accordance with the present invention was compared with the prior proposed color plasma display panel having an optimum phosphor thickness of 5 μm to 10 μm. The plasma display panel formed in accordance with the present invention had a surface averaged brightness which is about 1.4 times of that of the prior proposed one. In addition, the brightness of each pixel was about a double of that of the prior proposed one.

As mentioned hereinbefore, since the prior proposed color plasma display panel has been required to strictly control the thickness of the phosphor. On the other hand, although the plasma display panel formed in accordance with the present invention has a considerable variation in the thickness of the phosphor, the plasma display panel formed in accordance with the present invention has a uniform luminescent brightness throughout the whole surface of the display panel. Therefore, the plasma display panel formed in accordance with the present invention can greatly decrease the manufacturing cost.

Figure 2:
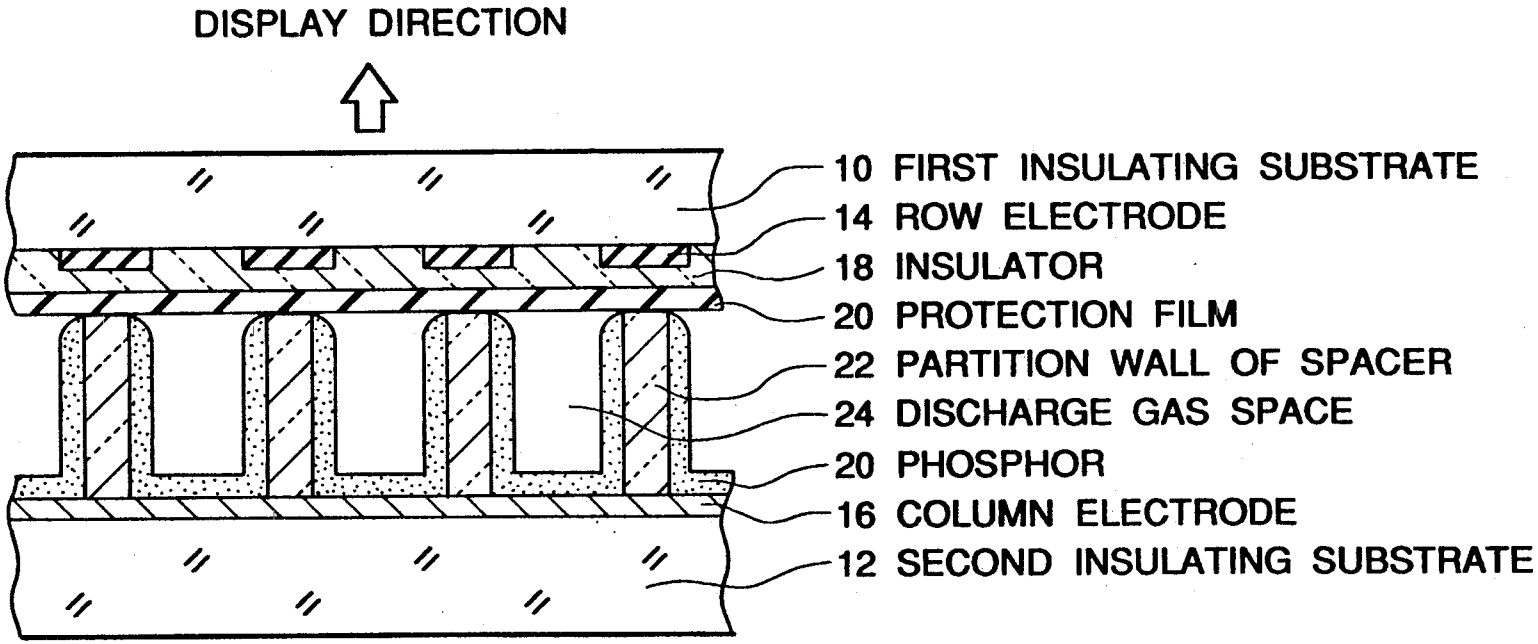
FIG. 2 is a diagrammatic partial sectional view similar to FIG. 1B but showing a modification of the plasma display panel shown in FIGS. 1A and 1B.

In the embodiment shown in FIGS. 1A and 1B, the phosphor 28 is deposited on only the second insulating substrate 12. However, the phosphor 28 can be deposited not only on the second insulating substrate 12, but also on a side surface of the partition wall 22, as shown in FIG. 2. This modification is effective in increasing the surface of the phosphor 28, and therefore in realizing a high brightness display panel.

Figure 3A:
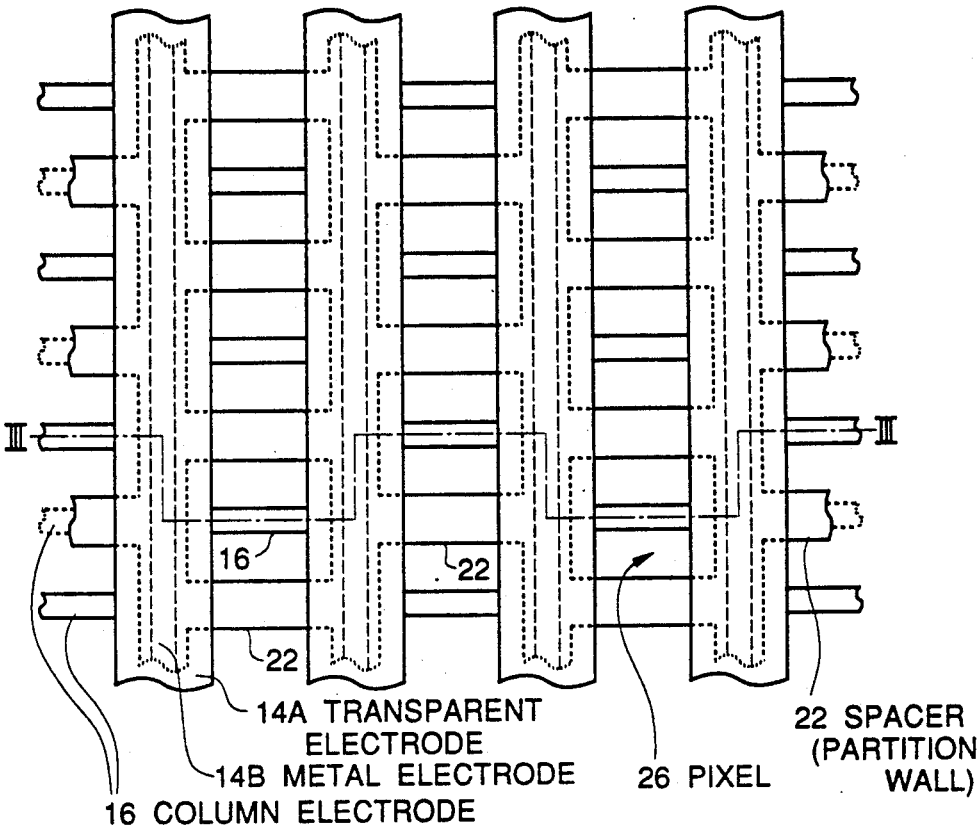
FIG. 3A is a diagrammatic partial plan view of a second embodiment of the plasma display panel in accordance with the present invention.
Figure 3B:
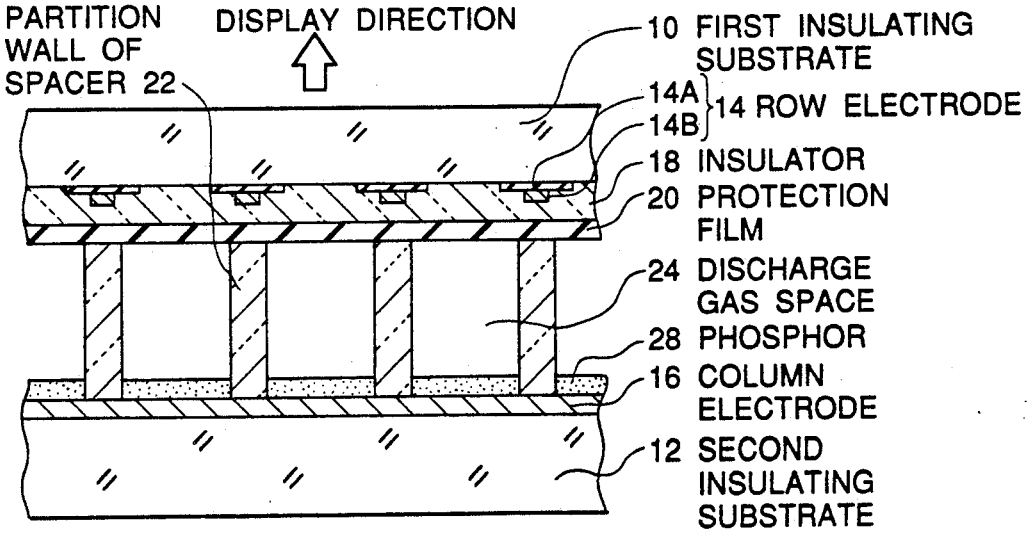
FIG. 3B is a diagrammatic partial sectional view taken along the chain line III—III in FIG. 3A.

Referring to FIGS. 3A and 3B, there is shown a second embodiment of the plasma display panel formed in accordance with the present invention. In FIGS. 3A and 3B, elements similar to those shown in FIGS. 1A and 1B are given the same Reference Numerals, and therefore, explanation thereof will be omitted.

In the second embodiment shown in FIGS. 3A and 3B, each of the row electrodes 14 includes a transparent electrode 14A formed of for example a $SnO_2$ film of the thickness 2000 Å, and a metal electrode 14B made of for example a thick film of silver (Ag). As seen from FIGS. 3A and 3B, the metal electrode 14B is stacked on the transparent electrode 14A, and has a width smaller than that of the partition wall 22 so that the metal electrode 14B is completely conceal by the partition wall 22. On the other hand, the transparent electrode 14A has a width larger than that of the partition wall 22 so that a peripheral portion of the transparent electrode 14A projects or protrudes from the partition wall 22.

With this arrangement, it was possible to extract the light emitted by the phosphor 28 more effectively than the first embodiment. If the row electrode 14 is formed of only the transparent electrode 14A, it is disadvantageous since the row electrode 14 has a high resistance. This problem has been overcome by stacking on the transparent electrode 14A the metal electrode 14B that has a width completely concealed by the partition wall 22. In this case, the metal electrode 14B has no influence against the extraction of the light emitted by the phosphor. This second embodiment succeeded in increasing the surface averaged brightness by 30% in comparison with the first embodiment.

In the second embodiment, the transparent electrode 14A has been formed of the $SnO_2$ film. However, the transparent electrode 14A can be formed of other materials, for example, an ITO film (a film of a mixture of $In_2O_3$ and $SnO_2$). In addition, the metal electrode 14B has been formed of the thick film of Ag, but can be formed of other materials, for example, a thick film or a thin film of Au (gold), Al (aluminum), Mo (molybdenum).

Figure 4A:
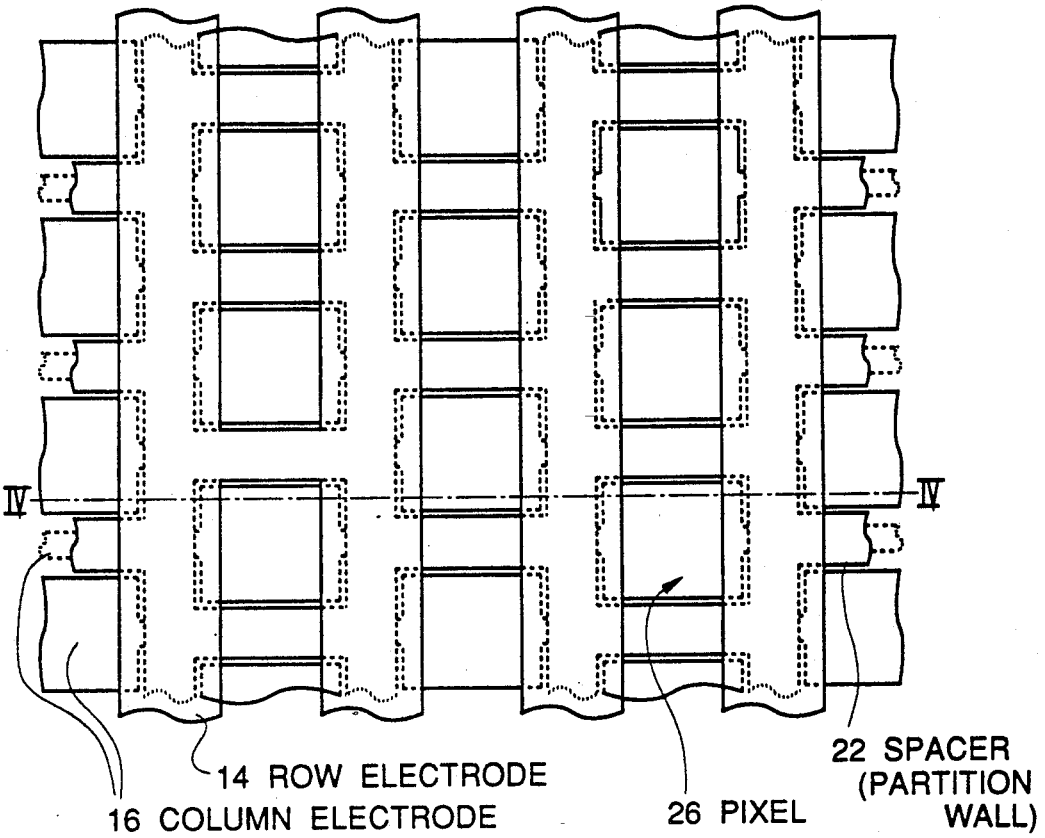
FIG. 4A is a diagrammatic partial plan view of a third embodiment of the plasma display panel in accordance with the present invention.
Figure 4B:
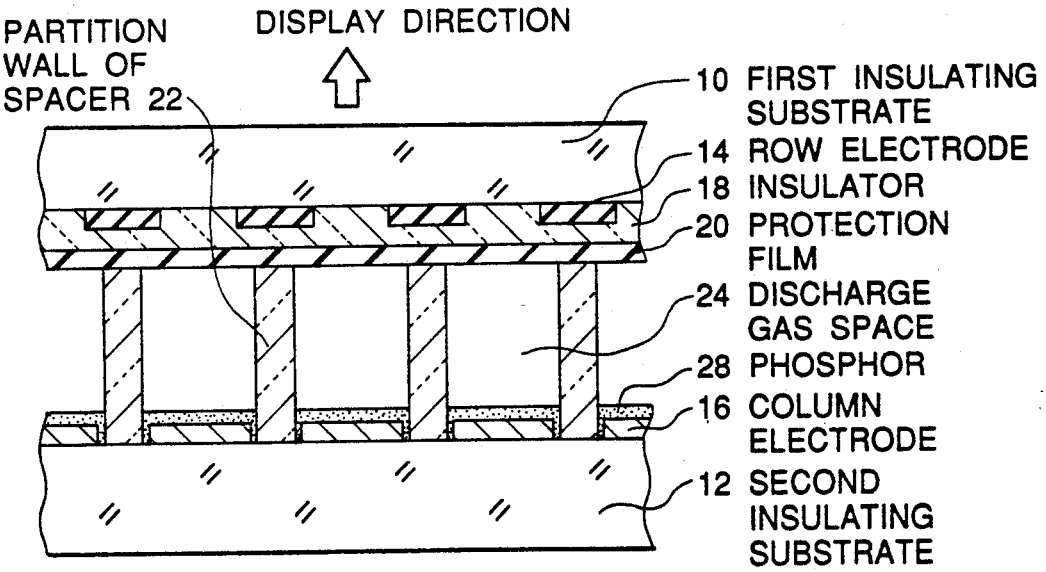
FIG. 4B is a diagrammatic partial sectional view taken along the chain line IV—IV in FIG. 4A.

Turning to FIGS. 4A and 4B, there is shown a third embodiment of the plasma display panel formed in accordance with the present invention. In FIGS. 4A and 4B, elements similar to those shown in FIGS. 1A and 1B are given the same Reference Numerals, and therefore, explanation thereof will be omitted.

In the third embodiment shown in FIGS. 4A and 4B, the column electrode 16 is formed by patterning a 5000 Å thickness evaporated aluminum film by means of photolithography. Specifically, the column electrode 16 has a pattern substantially completely overlapping a plane on which the phosphor is deposited, as seen from FIG. 4A.

The column electrode 16 underlying the phosphor 28 acts a mirror which reflects the light which is emitted by the phosphor 28 toward the second insulating substrate 12. Therefore, almost the light emitted by the phosphor 28 toward the second insulating substrate 12 is reflected by the column electrode 16 toward the first insulating substrate 10.

This third embodiment succeeded in increasing the surface averaged brightness by 30% or more in comparison with the first embodiment. In addition, if the second and third embodiments are combined, the surface averaged brightness can be improved by 70% or more in comparison with the first embodiment.

In FIGS. 4A and 4B, the pattern of the column electrode 14 has been depicted to be slightly smaller than the pattern of the phosphor 28. However, this is for convenience making it easier to look the drawing. Therefore, it is not necessary to do so. In any case, if a reflector is located under a portion of the phosphor 28, some degree of advantage can be expected.

Figure 5:
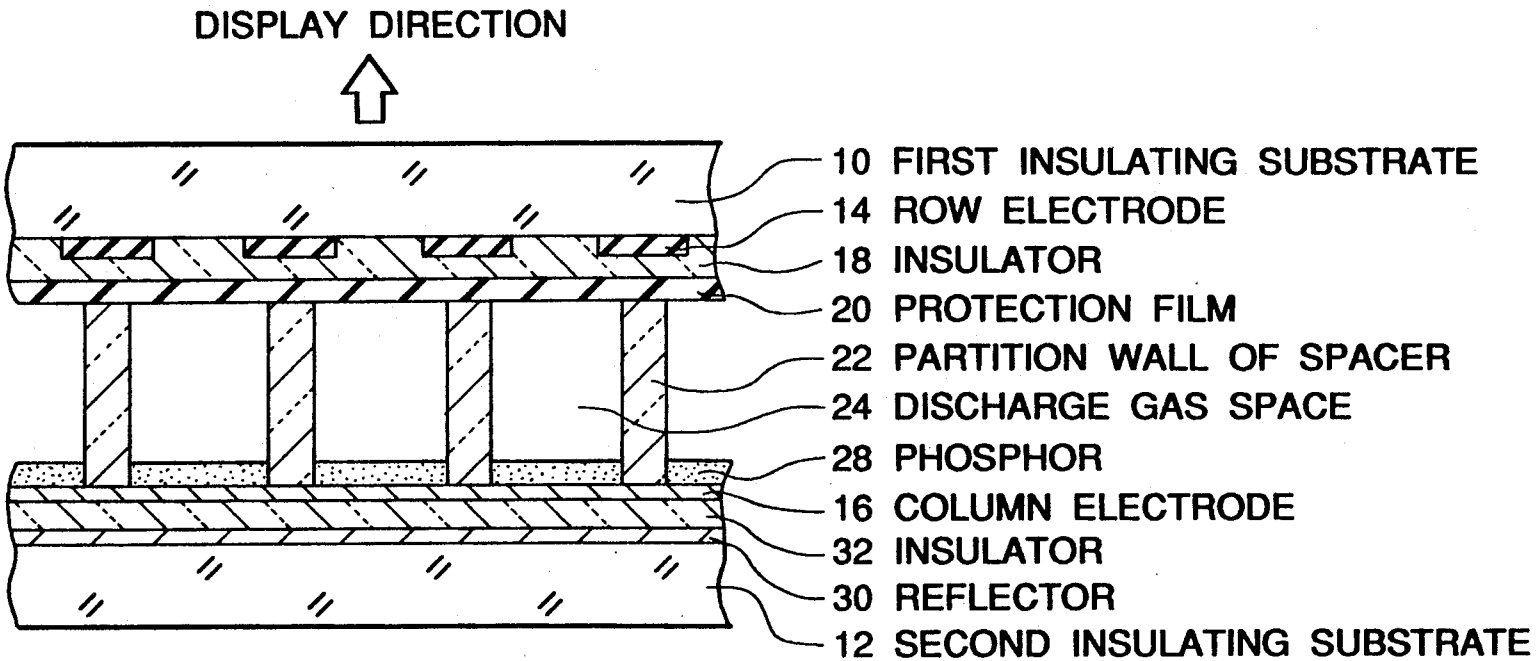
FIG. 5 is a diagrammatic partial sectional views similar to FIG. 4B but showing a modification of the plasma display panel shown in FIGS. 4A and 4B.

Alternatively, it is possible to locate under the phosphor 28 a reflector having a size or pattern completely covering all the phosphors 28. Referring to FIG. 5, there is shown such a modification. This modification has the same plan view as that shown in FIG. 1A, and therefore, a plan view will be omitted. FIG. 5 shows a diagrammatic sectional view of the modification.

The modification shown in FIG. 5 has a reflector 30 formed of a 2000 Å thickness aluminum film formed on the inside surface of the second insulating substrate 12, and an insulating layer 32 formed of a 5 μm thickness evaporated $Al_2O_3$ film. The column electrodes 16 are formed on the insulating layer 32. Therefore, the insulating layer 32 functions to electrically isolate the reflector 30 and the column electrodes 16 from each other. The reflector 30 extends over all the pixel region of the display panel or the whole of a screen of the display panel. Thus, the light emitted by the phosphor 28 toward the second insulating substrate 12 is reflected by the reflector 30 toward the first insulating substrate 10.

Figure 6:
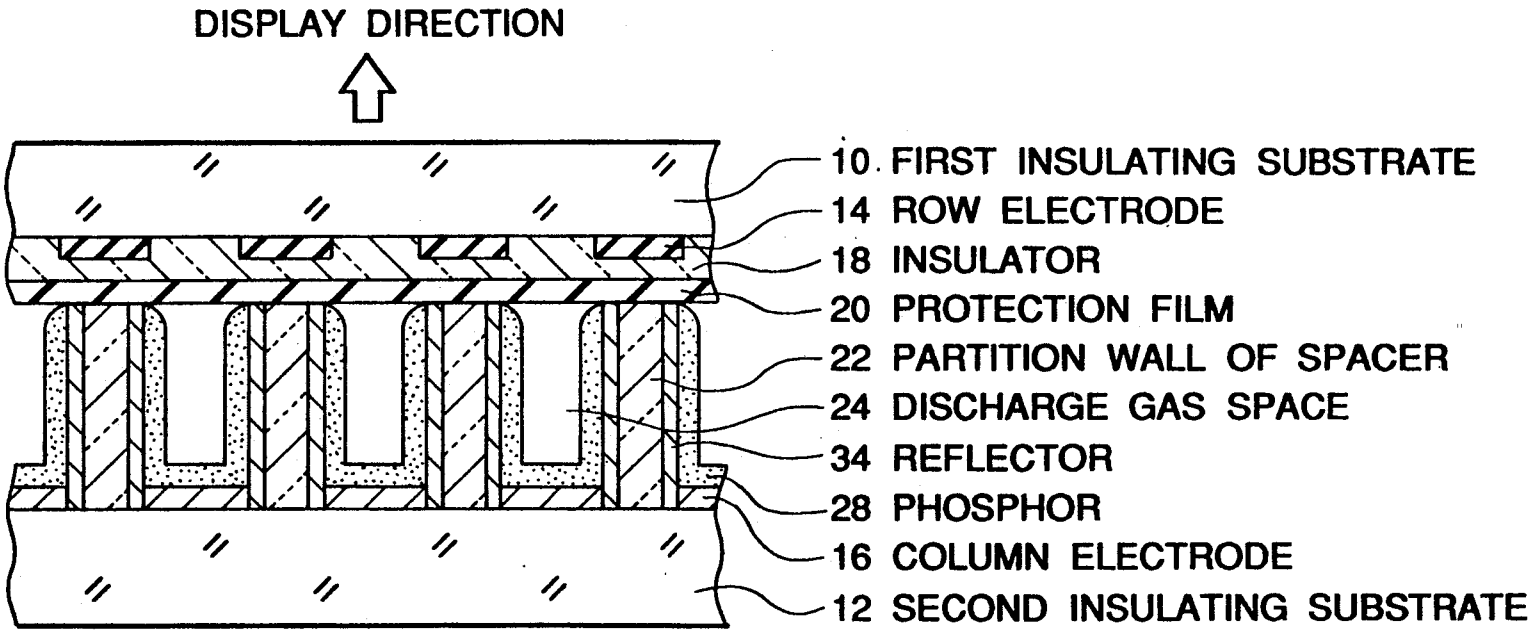
FIG. 6 is a diagrammatic partial sectional view similar to FIG. 4B but showing another modification of the plasma display panel shown in FIGS. 4A and 4B.

The third embodiment shown in FIGS. 4A and 4B can be modified as shown in FIG. 6. The modification shown in FIG. 6 has the same plane view as that shown in FIG. 4A, and therefore, only a diagrammatic sectional view is shown in FIG. 6. This modification has a reflector 34 formed on each side surface of the partition wall 22. This reflector 34 is formed of an evaporated aluminum film having a thickness of 2000 Å. The column electrode 16 has a plan pattern similar to that of the phosphor 26, similarly to the third embodiment shown in FIGS. 4A and 4B. In addition, the phosphor 28 is deposited on the second insulating substrate 12 and the side surface of the partition wall 22.

With this arrangement, a further improved brightness can be obtained.

In the third embodiment, the reflector is formed of aluminum, but can be formed of other materials, for example, chromium (Cr), and titanium (Ti).

The invention has thus been shown and described with reference to the specific embodiments. However, the above mentioned embodiments has been disclosed only for illustrating usefulness of the plasma display panel in accordance the present invention. Therefore, it should be noted that the present invention is in no way limited to the details of the illustrated structures but changes and modifications may be made within the scope of the appended claims.

I claim:

1. In a plasma display panel of the surface discharge type in which a maintaining discharge is generated between electrodes formed on the same substrate, said display panel including first and second insulating substrates separated from each other to form a discharge space therebetween, a spacer having a partition wall in the form of a grid located between said first and second insulating substrates so as to partition said discharge space into a number of pixels, each of of said pixels being defined by said first and second insulating substrates and said partition wall of said spacer, said pixels being separated from one another by said partition wall of said spacer; the improvement comprising: a discharge gas filling said discharge space, electrodes on said second insulating substrate for initiating a discharge of said discharge gas in said discharge space and extending in a first direction, electrodes on said first insulating substrate for maintaining said discharge and extending substantially along said partition wall in a second direction intersecting said first direction, each of said electrodes for maintaining said discharge including a combination of a transparent electrode and a metal electrode, and phosphor located on said second insulating substrate and on said discharge initiating electrodes, said first insulating substrate being located at a display side of said panel.

2. A plasma display panel as claimed in claim 1 wherein said metal electrode extends along said partition wall of said spacer and substantially covered with said partition wall of said spacer, and said transparent electrode is stacked on said metal electrode so as to extend along said metal electrode, said transparent electrode having a width larger than that of said partition wall of said spacer so that a peripheral portion of said transparent electrode extends outwardly beyond said partition wall of said spacer.

3. A plasma display panel as claimed in claim 1 wherein said second insulating substrate has visible light reflecting means provided between said phosphor and said second insulating substrate.

4. A plasma display panel as claimed in claim 3 wherein said visible light reflecting means comprised electrodes provided on said second insulating substrate.

5. A plasma display panel as claimed in claim 3 wherein said visible light reflecting means comprised a reflector formed on said second insulating substrate to cover the whole of said second insulating substrate.

6. A plasma display panel as claimed in claim 1 wherein said phosphor is deposited on said second insulating substrate and on an inside surface of said partition wall of said spacer within each of said pixels.

7. In a plasma display panel of the surface discharge type in which a maintaining discharge is generated between electrodes formed on the same substrate, said panel including first and second insulating substrate separated from each other to form a discharge space therebetween, a spacer having a partition wall in the form of a grid located between said first and second insulating substrates so as to partition said discharge space into a number of pixels, each of the pixels being defined by said first and second insulating substrate and said partition wall of said spacer, said pixels being separated from one another by said partition wall of said spacer, wherein the improvement comprises: a discharge gas filling said discharge space, electrodes on said second insulating substrate for initiating a discharge of said discharge gas in said discharge space and extending in a first direction, phosphor located on said second insulating substrate and said discharge initiating electrodes, electrodes on said first insulating substrate for maintaining said discharge and extending substantially along said partition wall in a second direction intersecting said first direction, each of said electrodes for maintaining said discharge including a combination of a transparent electrode and a metal electrode, said metal electrode extending along said partition wall of said spacer and being substantially covered with said partition wall of said spacer, and said transparent electrode being stacked on said metal electrode so as to extend along said metal electrode, said transparent electrode having a width which is larger than a width of said partition wall of said spacer so that a peripheral portion of said transparent electrode extends outwardly beyond said partition wall of said spacer, said first insulating substrate, being located at a display side of said panel.

8. A plasma display panel as claimed in claim 7 wherein said phosphor is deposited on said second insulating substrate and on an inside surface of said partition wall of said spacer within each of said pixels.

9. A plasma display panel as claimed in claim 8 wherein said second insulating substrate has visible light reflecting means provided between said phosphor and said second insulating substrate so that visible light emitted from said phosphor toward said second insulating substrate is reflected toward said first insulating substrate.

10. A plasma display panel as claimed in claim 9 wherein said visible light reflecting means comprises electrodes provided on said second insulating substrate.

11. A plasma display panel as claimed in claim 9 wherein said visible light reflecting means comprises a reflector formed on said second insulating substrate to cover the whole of said second insulating substrate.

12. In a plasma display panel of the surface discharge type in which a maintaining discharge is generated between electrodes formed on the same substrate, said panel including first and second insulating substrate separated from each other to form a discharge space therebetween, a spacer having a partition wall in the form of a grid located between said first and second insulating substrate so as to partition said discharge space into a number of pixels, each of said pixels being defined by said first and second insulating substrate and said partition wall of said spacer, said pixels being separated from one another by said partition wall of said spacer, wherein the improvement comprises: a discharge gas filling said discharge space, electrodes on said second insulating substrate for initiating a discharge of said discharge gas in said discharge space and extending in a first direction, phosphor located on said second insulating substrate and said discharge initiating electrodes, and electrodes on said first insulating substrate for maintaining said discharge and extending substantially along said partition wall in a second direction intersecting said first direction, an insulating layer covering said discharge maintaining electrodes and said first insulating substrate, a protection film covering said insulating layer, each of said discharge maintaining electrodes including a combination of a transparent electrode and a metal electrode, said metal electrode extending along said spacer partition wall and being substantially covered by said partition wall of said spacer, and said transparent electrode being stacked on said metal electrode so as to extend along said metal electrode, said transparent electrode having a width which is larger than the width of said spacer partition wall so that a peripheral portion of said transparent electrode extends outwardly beyond said spacer partition wall, said first insulating substrate being located at a display side of said panel.

* * * * *